US006336733B1

(12) United States Patent
Huang

(10) Patent No.: US 6,336,733 B1
(45) Date of Patent: Jan. 8, 2002

(54) LAMP SHADE FOR A CHRISTMAS LIGHT

(76) Inventor: Shun-Feng Huang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/664,917

(22) Filed: Sep. 18, 2000

(51) Int. Cl.[7] ..... F21V 21/00

(52) U.S. Cl. ..... 362/249; 362/230; 362/353; 362/396; 362/806

(58) Field of Search ..... 362/396, 806, 362/249, 351, 353, 363, 311, 235, 237, 293, 230

(56) References Cited

U.S. PATENT DOCUMENTS 4,679,126 A * 7/1987 Van Sickler ..... 362/226

6,004,006 A * 12/1999 Wang ..... 362/249

* cited by examiner

*Primary Examiner*—Sandra O'Shea
*Assistant Examiner*—John Anthony Ward

(57) ABSTRACT

A lamp shade for a Christmas light includes a Christmas light having a pair of flexible hooks on the opposing outer circumferences of the socket and a pair of snap projections on the opposing outer circumferences of the socket alternative with the hooks and a colored lamp shade which has an olives-shaped body, a circular extension on the bottom of the body engageable with the top of the light, a pair of openings in the opposing circumferential walls of the extension to define a pair of damper ends thereaside engageable with the hooks and a pair of elongate slots in the opposing circumferential walls of the extension alternate with the openings and made engageable with the snap projections in a snap fitting.

3 Claims, 4 Drawing Sheets

(2 – 2)

(2' – 2')

LAMP SHADE FOR A CHRISTMAS LIGHT

BACKGROUND OF THE INVENTION

The present invention relates the Christmas light and more particularly to a lamp shade for a Christmas light which improves the brightness of the Christmas light and makes the Christmas light colorful to achieve its decoration effect.

Typical Christmas light as previously discovered by my U.S. Pat. No. 5,669,707 which has a flexible hooked projection on an outer circumference of the socket and a group of cords passed through the bottom thereof. Each group of cords are passing through several sockets of the kind. One of the first group of cords is passed into the flexible hooked projection of the sockets linked by other group of cords such that the sockets are combined to have various patterns for decorational purpose. However, people recently provide a colorful lamp shade on the Christmas light to obtain more cosmetic effect. If a colorful lamp shade made in corporation with my previous disclosure, the group of the Christmas lights could be looked more brightness and more colorful.

SUMMARY OF THE PRESENT INVENTION

The present invention has a main object to provide a lamp shade connected to a Christmas light which lamp shade not only improves the brightness and decoration effect for the light but also prevents the electrical wire from broken off the flexible hooks of the light.

Accordingly, the shade for a Christmas light comprises generally a pair of flexible hooks formed on opposing outer circumferences of the light and a pair of snap projections on the opposing outer circumferences alternate with the hooks and a lamp shade which has an olives-shaped body and a circular extension on the bottom thereof. The extension has a pair of openings in opposing circumferences engageable with the flexible hooks a damper end define on one side of the openings and a pair elongate slots in opposing circumferential walls of the extension alternate with the openings. When the lamp shade connects to the top of the Christmas light, the elongate slots will be engaged with the snap projections in a snap fitting, the openings will be engaged with the flexible hooks and the damper ends will block the opening end of the hooks to prevent the electrical wires from breaking off the hooks.

The present invention will become more fully understood by reference to the following detailed description thereof when read in conjunction with the attached drawings.

DETAILED DESCRIPTION OF THE PREFERRED EMBODIMENT

Figure 1:
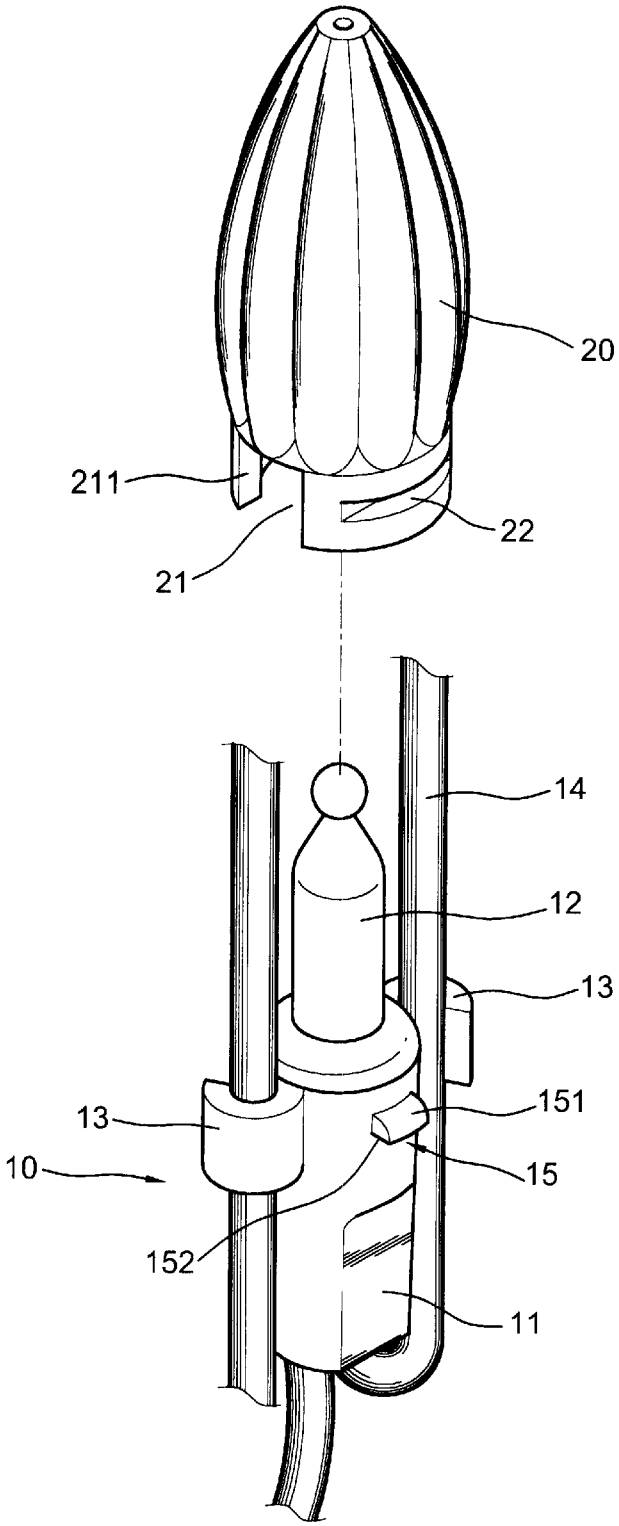
FIG. 1 is an exploded perspective view to show the lamp shade for a Christmas light of the preferred embodiment according to the present invention.
Figure 2:
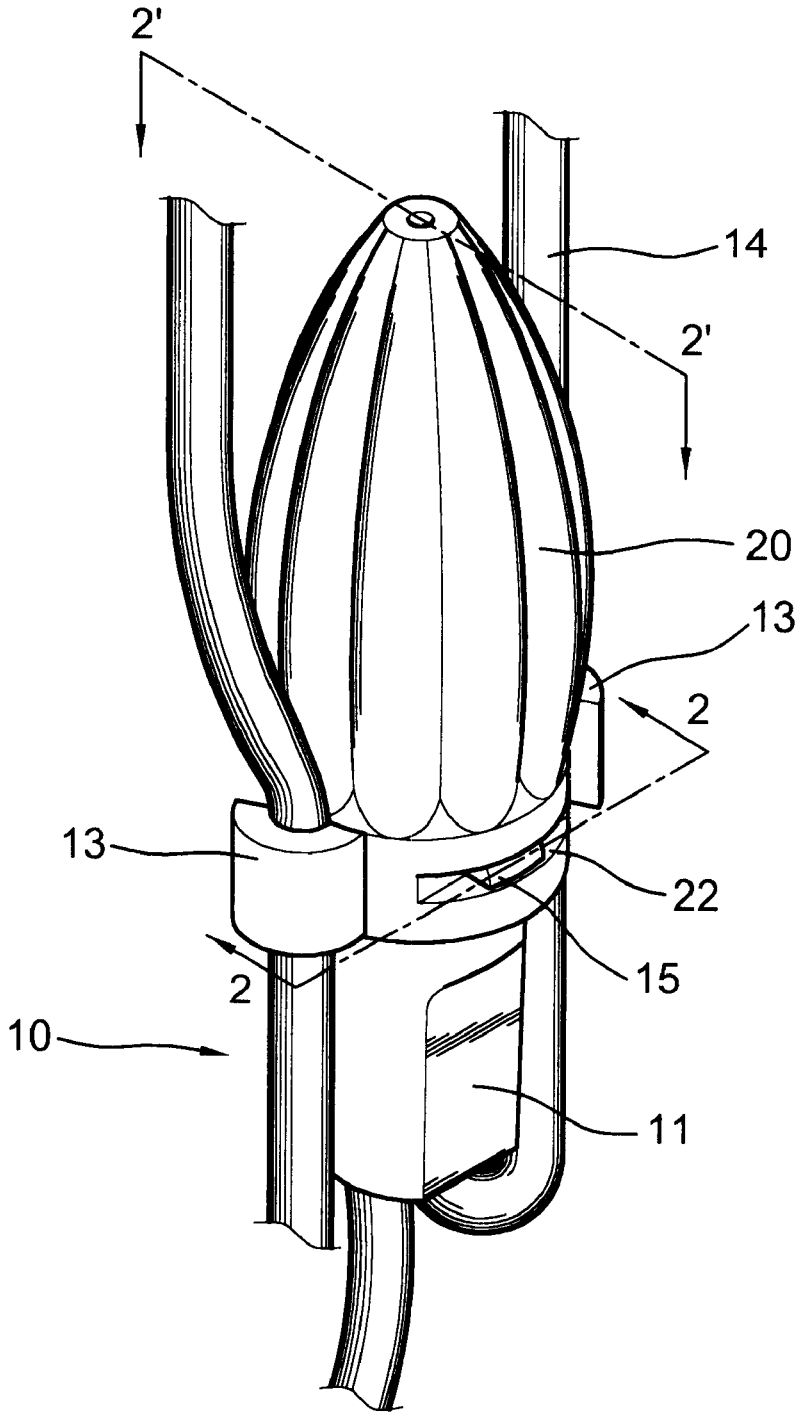
FIG. 2 is a perspective view to show an assembly of FIG. 1.
Figure 3:
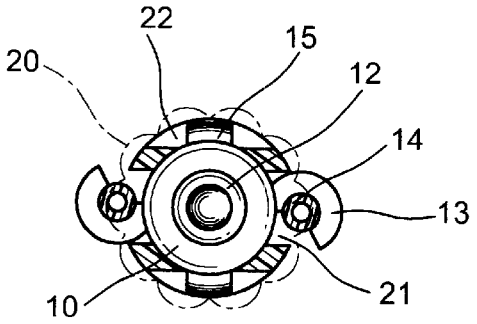
FIG. 3 is a sectional view taken along line 2—2 of FIG. 2.
Figure 4:
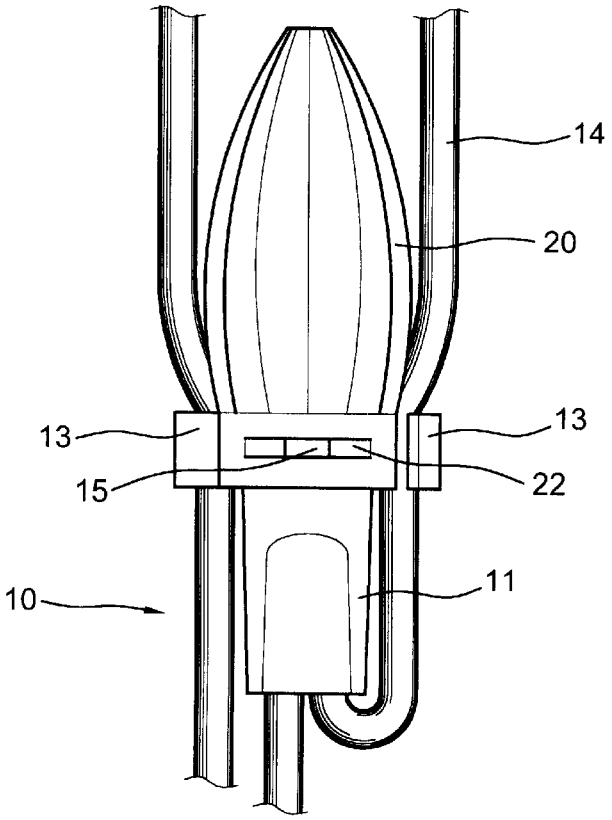
FIG. 4 is an elevational view of FIG. 2.
Figure 5:
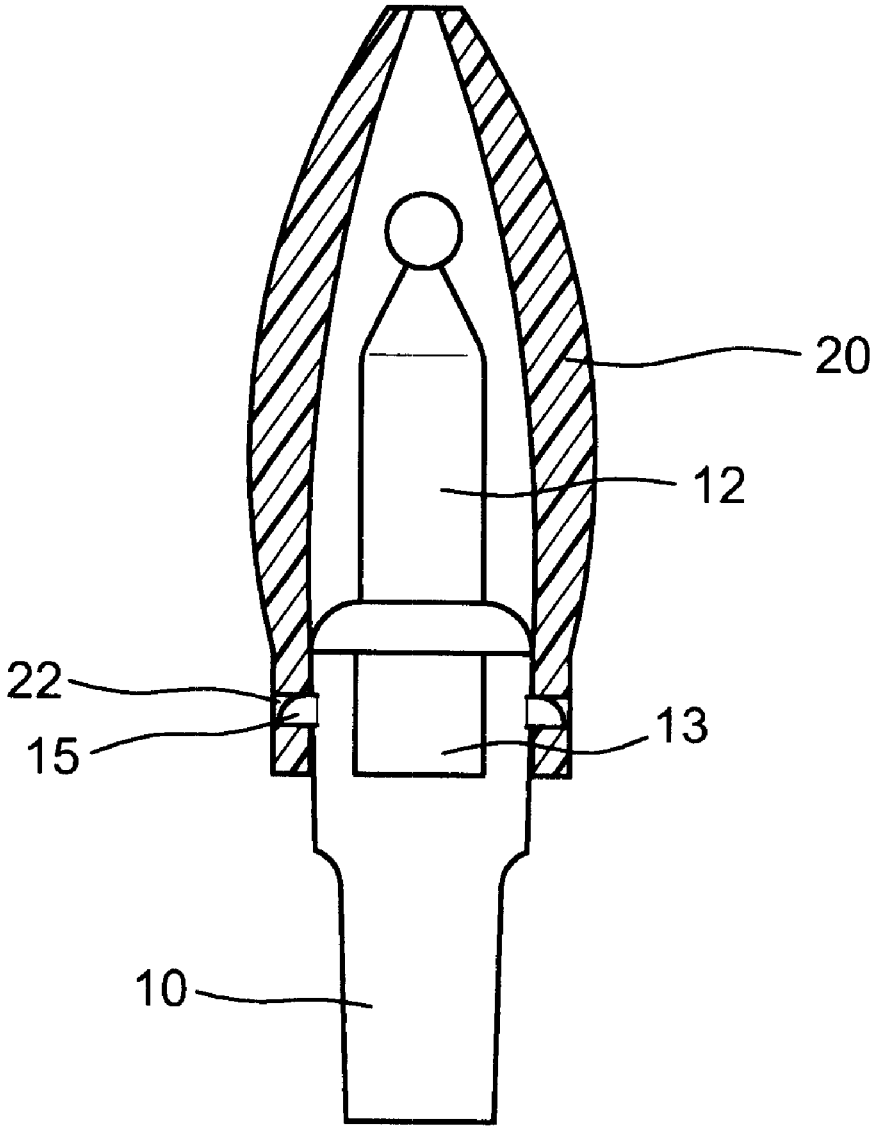
FIG. 5 is a sectional view taken along line 2'—2' of FIG. 2.

With reference to FIG. 1 of the drawings, the lamp shade for a Christmas light of the present invention comprises generally a Christmas light 10 and a colored lamp shade 20.

The Christmas light 10 has a socket 11, a lamp 12 engaged with the top of the socket 11, a pair of flexible hooks 13 projected outward from the opposing circumferences of the socket 11 for engaging a pair of electrical wires 14 therein and a pair of snap projections 15 projected outward from the opposing outer circumferences alternate with the hooks 13. The snap projections 15 has an arcuate outer surface 151 and a plane bottom 152.

The colored lamp shade 20 made of transparent material has an olives-shaped body and a flexible circular extension extending downward from the body engageable with the socket 11 of the light 10. The extension has a pair of rectangular openings 21 in the opposing circumferential walls made engageable with the hooks 13 of the light 10, a pair of elongate slots 22 in the circumferential walls alternate with the openings 21 made engageable with the snap projections 15 of the socket 11 and a damper end 211 defined by each of the openings 21. elongate slots 22 in the circumferential walls alternate with the openings 21 made engageable with the snap projections 15 of the socket 11 and a damper end defined by each of the openings 21.

When assembling, engage the lamp shade 20 on the top of the Christmas light 10 with the openings 21 respectively engaged with the flexible hooks 13, the snap projections 15 will be automatically slid into the elongate slots 22 on a slight pressure because of the arucate outer surface 151 of the snap projections 15 and the slot 22 will not be broken off because of the plane bottom 152 of the snap projections either. Then make a slight rotation of the lamp shade 20 laterally, the damper ends 211 of the openings 21 will block the opening ends of the hooks 13 such that the electrical wires will not break off the hooks 13 (as shown in FIGS. 2, 3, 4 and 5).

The above discussed structure of the lamp shade 20 not only improves the brightness and the decoration effect of the Christmas light but also prevents the electrical wires 14 from breaking off in cooperation with the flexible hooks 13 of the socket 11. Further, the lamp shade 20 has a function of waterproof.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A lamp shade for a Christmas light comprising:

a Christmas light having a socket, a lamp engaged in top of the socket, a pair of flexible hooks respectively projected outward from opposing circumferences of the socket for respectively disposing a pair of electrical wires therein and a pair of snap projections respectively projected outward from opposing circumferences of the socket alternate with the hooks;

a colored lamp shade engaged on top of the Christmas light having an olives-shaped body, a circular extension extending downward from the body, a pair of rectangular openings respectively formed in opposing circumferential walls of the extension engageable with the hooks of the socket each defining a damper end thereaside enabling to block the hooks and a pair of elongate slots respectively formed in opposing circumferential walls of the extension alternate with the openings and made engageable with the snap projections of the socket in a snap fitting.

2. The lamp shade as recited in claim 1 wherein said snap projections each has an arcuate outer surface and a plane bottom.

3. The lamp shade as recited in claim 1 wherein said lamp shade is made of transparent material.

* * * * *